US011037775B2

(12) United States Patent
Giles et al.

(10) Patent No.: US 11,037,775 B2
(45) Date of Patent: Jun. 15, 2021

(54) ION GUIDE

(71) Applicant: Micromass UK Limited, Wilmslow (GB)

(72) Inventors: Kevin Giles, Stockport (GB); Jason Lee Wildgoose, Stockport (GB); Martin Raymond Green, Bowdon (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 15/315,610

(22) PCT Filed: Jun. 9, 2015

(86) PCT No.: PCT/GB2015/000167
§ 371 (c)(1),
(2) Date: May 10, 2017

(87) PCT Pub. No.: WO2015/189539
PCT Pub. Date: Dec. 17, 2015

(65) Prior Publication Data

US 2017/0200597 A1 Jul. 13, 2017

(30) Foreign Application Priority Data

Jun. 10, 2014 (EP) ..... 14171764
Jun. 10, 2014 (GB) ..... 1410269

(51) Int. Cl.
*H01J 49/06* (2006.01)
*H01J 49/42* (2006.01)

(52) U.S. Cl.
CPC ..... *H01J 49/065* (2013.01); *H01J 49/4235* (2013.01)

(58) Field of Classification Search
None
See application file for complete search history.

(56) References Cited

U.S. PATENT DOCUMENTS 3,501,631 A 3/1970 Arnold
7,498,569 B2 3/2009 Ding
(Continued)

FOREIGN PATENT DOCUMENTS

CN 1585081 A 2/2005
CN 101632148 A 1/2010
(Continued)

OTHER PUBLICATIONS

Bollen, G."*'Ion Surfing' with Radiofrequency Carpets*", International Journal of Mass Spectrometry, #299, 131-138, (2011).
(Continued)

*Primary Examiner* — Andrew Smyth
(74) *Attorney, Agent, or Firm* — Kacvinsky Daisak Bluni PLLC

(57) ABSTRACT

An ion guide is disclosed comprising a first array of electrodes and a second array of electrodes and one or more apertures or ion exit regions. The first array of electrodes comprises a first plurality of arcuate electrodes arranged in parallel with one another and such that said first plurality of arcuate electrodes at least partially surround said one or more apertures or ion exit regions and/or wherein said second array of electrodes comprises a second plurality of arcuate electrodes arranged in parallel with one another and such that said second plurality of arcuate electrodes at least partially surround said one or more apertures or ion exit regions. The ion guide comprises a first device arranged and adapted to apply an AC or RF voltage to said first array of electrodes and to said second array of electrodes so as to confine ions within said ion guide in a first (z) direction that extends in a direction between said first and second arrays, and a second device arranged and adapted to apply one or more DC voltages to said first array of electrodes and/or to said second array of electrodes so as to urge ions within said
(Continued)

ion guide in a second (r) direction towards said one or more apertures or ion exit regions, such that ions within said ion guide are caused to migrate to said one or more apertures or ion exit regions.

14 Claims, 4 Drawing Sheets

(56) References Cited

U.S. PATENT DOCUMENTS

| | | | | |
|---|---|---|---|---|
| 7,723,679 | B2 * | 5/2010 | Tolley | H01J 49/4235 250/292 |
| 8,946,626 | B2 | 2/2015 | Giles et al. | |
| 9,548,194 | B2 | 1/2017 | Giles et al. | |
| 2001/0002696 | A1 | 6/2001 | Kato | |
| 2002/0027195 | A1 | 3/2002 | Kato | |
| 2004/0079880 | A1 * | 4/2004 | Bateman | H01J 49/424 250/288 |
| 2009/0194688 | A1 * | 8/2009 | Bateman | H01J 49/4215 250/292 |
| 2010/0243886 | A1 | 9/2010 | Flory et al. | |
| 2010/0301227 | A1 * | 12/2010 | Muntean | H01J 49/063 250/396 R |
| 2011/0062323 | A1 * | 3/2011 | Brown | H01J 49/28 250/282 |
| 2013/0099110 | A1 * | 4/2013 | Hoyes | H01J 49/34 250/282 |

FOREIGN PATENT DOCUMENTS

| | | | |
|---|---|---|---|
| GB | 1293148 | A | 10/1972 |
| WO | 2011/089419 | A2 | 7/2011 |
| WO | 2013/027054 | A2 | 2/2013 |

OTHER PUBLICATIONS

Arai, F., et al., "*Investigation of the Ion Surfing Transport Method with a Circular RF Carpet*", International Journal of Mass Spectrometry, http://dx.doi.org/doi:10.1016/j.ijms.2014.01.005 (2014).

Austin, D., et al., "*Halo Ion Trap Mass Spectrometer*", Analytical Chemistry, vol. 79, No. 7, 2927-2932, (Apr. 2007).

English translation of Office Action and Examination Report in CN Application No. 201580028889.7, dated Feb. 2, 2018.

* cited by examiner

ION GUIDE

CROSS-REFERENCE TO RELATED APPLICATIONS

This application represents the U.S. National Phase of International Application number PCT/GB2015/000167 entitled "Ion Guide" filed 9 Jun. 2015, which claims priority from and the benefit of United Kingdom patent application No. 1410269.3 filed on 10 Jun. 2014 and European patent application No. 14171764.5 filed on 10 Jun. 2014. The entire contents of these applications are incorporated herein by reference.

FIELD OF THE INVENTION

The present invention relates to an ion guide and a method of guiding ions.

BACKGROUND

There are many situations in mass spectrometry systems where ions from various types of distributed source need to be focused or concentrated, e.g. for passage through subsequent differential apertures or ion optics. State-of-the art ion concentration devices, in general, slowly urge ions from a diffuse source to a more focused beam as they transit axially along the device.

It is desired to provide an improved ion guide.

SUMMARY

According to an aspect there is provided an ion guide comprising:

a first array of electrodes and a second array of electrodes;

one or more apertures or ion exit regions;

wherein the first array of electrodes comprises a first plurality of arcuate electrodes arranged in parallel with one another and such that the first plurality of arcuate electrodes at least partially surround the one or more apertures or ion exit regions and/or wherein the second array of electrodes comprises a second plurality of arcuate electrodes arranged in parallel with one another and such that the second plurality of arcuate electrodes at least partially surround the one or more apertures or ion exit regions;

a first device arranged and adapted to apply an AC or RF voltage to the first array of electrodes and to the second array of electrodes so as to confine ions within the ion guide in a first (z) direction that extends in a direction between the first and second arrays;

a second device arranged and adapted to apply one or more DC voltages to the first array of electrodes and/or to the second array of electrodes so as to urge ions within the ion guide in a second (r) direction towards the one or more apertures or ion exit regions, such that ions within the ion guide are caused to migrate to the one or more apertures or ion exit regions.

According to various embodiments, an ion guide is provided that can advantageously receive ions across a wide range of angular (θ) displacements (e.g. up to 360°), transport the ions towards an ion exit region, and then eject the ions in a relatively narrow ion beam. Thus, the ion guide can advantageously be used to collimate ions from one or more curved or annularly distributed sources to a single beam. According to an embodiment, ions appearing at any point on the circumference of the ion entrance region, at any given time, will advantageously be transported and focused to the one or more exit regions together, maintaining their temporal fidelity.

WO 2008/103492 discloses a coaxial analytical ion trap mass analyser from which ions are mass-selectively ejected. WO 2013/027054 discloses a toroidal analytical ion trap from which ions are resonantly or parametrically ejected by applying a supplemental AC voltage.

These documents disclose analytical ion traps, and do not disclose an ion guide in accordance with the present invention. The ion guide according to various embodiments is not an analytical trap. Moreover, these documents do not disclose a device arranged and adapted to apply one or more DC voltages so as to urge ions within the ion guide in a radial direction such that ions migrate to an ion exit. Although WO 2013/027054 discloses a DC well which forces ions towards the central/outer area of the ion trap, the DC well traps ions and does not cause ions to migrate to (or out of) an ion exit.

Accordingly, these documents relate to toroidal structures for providing large trapping volumes, and are not concerned with the concept of interfacing a large ion acceptance area to a small ion exit area. Furthermore, these documents do not disclose an ion guide that "passively" funnels ions towards an ion exit while maintaining the temporal fidelity of ions.

For the avoidance of doubt, the term "arcuate electrodes" as used herein should be understood to encompass both arrangements of electrodes that partially surround the one or more apertures or ion exit/entrance regions such as arc-shaped electrodes, and arrangements of electrodes that fully surround the one or more apertures or ion exit/entrance regions such as circular- or oval-shaped electrodes.

The first plurality of arcuate electrodes may be arranged in a sector or circular sector configuration and/or the second plurality of arcuate electrodes may be arranged in a sector or circular sector configuration.

The one or more apertures or ion exit regions may be arranged within the first array and/or within the second array; and the first plurality of arcuate electrodes may be arranged concentrically around the one or more apertures or ion exit regions and/or the second plurality of arcuate electrodes may be arranged concentrically around the one or more apertures or ion exit regions.

According to an aspect there is provided an ion guide comprising:

a first array of electrodes and a second array of electrodes;

one or more apertures or ion exit regions arranged within the first array, such that the electrodes in the first array of electrodes are arranged concentrically around the one or more apertures or ion exit regions and/or one or more apertures or ion exit regions arranged within the second array, such that the electrodes in the second array of electrodes are arranged concentrically around the one or more apertures or ion exit regions;

a first device arranged and adapted to apply an AC or RF voltage to the first array of electrodes and to the second array of electrodes so as to confine ions within the ion guide in a first (z) direction that extends in a direction between the first and second arrays;

a second device arranged and adapted to apply one or more DC voltages to the first array of electrodes and/or to the second array of electrodes so as to urge ions within the ion guide in a second (r) direction towards the one or more apertures or ion exit regions, such that ions within the ion guide are caused to migrate to the one or more apertures or ion exit regions.

The second device may be arranged and adapted to apply the one or more DC voltages to the first array of electrodes and/or to the second array of electrodes so as to urge ions within the ion guide in the second (r) direction towards the one or more apertures or ion exit regions, such that ions at most or all angular (θ) displacements within the ion guide are caused to migrate to the one or more apertures or ion exit regions.

The first device may be arranged and adapted to apply the AC or RF voltage to the first array of electrodes so as to generate a pseudo-potential barrier and to apply the AC or RF voltage to the second array of electrodes so as to generate a pseudo-potential barrier which act to confine ions within the ion guide in the first (z) direction.

The first array of electrodes may be arranged in a first plane and/or the second array of electrodes may be arranged in a second plane; or the first array of electrodes may be arranged in a non-planar configuration and/or the second array of electrodes may be arranged in a non-planar configuration.

The first array of electrodes may be arranged in a cone-shaped or dome-shaped configuration and/or the second array of electrodes may be arranged in a cone-shaped or dome-shaped configuration.

The first and second arrays of electrodes may be arranged at different displacements in the first (z) direction; and/or the first plane and the second plane may be parallel; and/or the second (r) direction may be parallel to the first plane and/or to the second plane; and/or the second (r) direction may be a radial direction relative to an axis about which the first and/or second plurality of arcuate electrodes are arranged; and/or the second (r) direction may be a radial direction relative to an axis about which the first array of electrodes and/or the second array of electrodes are concentric; and/or the first (z) direction may be substantially orthogonal to the second (r) direction and/or to the first plane and/or to the second plane.

The first array of electrodes may comprise a first plurality of continuous electrodes, wherein each continuous electrode is arranged concentrically around the one or more apertures or ion exit regions and/or the second array of electrodes comprises a second plurality of continuous electrodes, wherein each continuous electrode is arranged concentrically around the one or more apertures or ion exit regions; and/or the first array of electrodes may comprise a first plurality of groups of electrodes, wherein each group of electrodes is arranged concentrically around the one or more apertures or ion exit regions so as to substantially surround the one or more apertures or ion exit regions and/or the second array of electrodes comprises a second plurality of groups of electrodes wherein each group of electrodes is arranged concentrically around the one or more apertures or ion exit regions so as to substantially surround the one or more apertures or ion exit regions.

At least one of the one or more apertures or ion exit regions may be arranged:

at the centre of the first and/or second plurality of concentric electrodes; and/or at the centre of the first and/or second plurality of concentric groups of electrodes.

The first array of electrodes may comprise a first plurality of closed loop, ring, circular or oval electrodes arranged concentrically around the one or more apertures or ion exit regions and/or the second plurality of electrodes comprises a second plurality of closed loop, ring, circular or oval electrodes arranged concentrically around the one or more apertures or ion exit regions; and/or the first array of electrodes may comprise a first plurality of rotationally symmetric groups of electrodes wherein each of the groups of electrodes is arranged concentrically around the one or more apertures or ion exit regions and/or the second plurality of electrodes comprises a second plurality of rotationally symmetric groups of electrodes wherein each of the groups of electrodes is arranged concentrically around the one or more apertures or ion exit regions.

The ion guide may further comprise one or more ion entrance regions arranged and adapted such that ions can enter the ion guide via the one or more ion entrance regions in the first (z) and/or the second (r) direction, and at some, most or all angular (θ) displacements around an axis about which the first plurality of arcuate electrodes and/or the second plurality of arcuate electrodes are arranged.

The ion guide may further comprise one or more ion entrance regions arranged and adapted such that ions can enter the ion guide via the one or more ion entrance regions in the first (z) and/or the second (r) direction, and at some, most or all angular (θ) displacements around an axis about which the first array of electrodes and/or the second array of electrodes are concentric.

The one or more ion entrance regions may be arranged and adapted such that ions can enter the ion guide between the first and second arrays at the perimeter or circumference of the first and/or second array in a direction (r) parallel to the first and/or second array and/or orthogonal to the direction (z) in which ions exit the ion guide.

The one or more ion entrance regions may be arranged and adapted such that ions can enter the ion guide close to the perimeter or circumference of the first and/or second array in a direction (z) orthogonal to the first and/or second array and/or parallel to the direction (z) in which ions exit the ion guide.

The one or more ion entrance regions may be arranged and adapted such that ions can enter the ion guide at at least 10%, 20%, 30%, 40%, 50%, 60%, 70%, 80%, 90% or 95% of the angular (θ) displacements.

The ion guide may further comprise:

one or more entrance electrode arrangements arranged adjacent to the one or more ion entrance regions.

The second device may be arranged and adapted to urge ions within the ion guide in the second (r) direction to the one or more apertures or ion exit regions, such that ions, that are at any angular (θ) displacement around an axis about which the first and/or the second plurality of arcuate electrodes are arranged, within the ion guide are caused to migrate to the one or more apertures or ion exit regions.

The second device may be arranged and adapted to urge ions within the ion guide in the second (r) direction to the one or more apertures or ion exit regions, such that ions within the ion guide that are at at least 50%, 60%, 70%, 80%, 90% or 95% of angular (θ) displacements around an axis about which the first and/or the second arrays of electrodes are concentric are caused to migrate to the one or more apertures or ion exit regions.

The second device may be arranged and adapted to urge ions within the ion guide in the second (r) direction to the one or more apertures or ion exit regions such that ions within the ion guide at some, most or all radial (r) displacements, relative to an axis about which the first and/or the second plurality of arcuate electrodes are arranged, are caused to migrate to the one or more apertures or ion exit regions.

The second device may be arranged and adapted to urge ions within the ion guide in the second (r) direction to the one or more apertures or ion exit regions such that ions within the ion guide at some, most or all radial (r) displacements, relative to an axis about which the first and/or the second arrays of electrodes are concentric, are caused to migrate to the one or more apertures or ion exit regions.

The second device may be arranged and adapted to urge ions within the ion guide in the second (r) direction towards the one or more apertures or ion exit regions such that ions at at least 50%, 60%, 70%, 80%, 90% or 95% of radial (r) displacements within the ion guide are caused to migrate to the one or more apertures or ion exit regions.

The second device may be arranged and adapted to apply one or more static or time-varying DC voltages to the first array of electrodes and/or to the second array of electrodes so as to urge the ions within the ion guide in the second (r) direction towards the one or more apertures or ion exit regions.

The second device may be arranged and adapted:

to apply different DC voltages to different electrodes of the first array of electrodes and/or the second array of electrodes so as to create a DC voltage gradient that urges ions within the ion guide in the second (r) direction to the one or more apertures or ion exit regions; and/or to successively apply a DC voltage to different electrodes of the first array of electrodes and/or the second array of electrodes so as to create a travelling DC potential barrier that travels in the second (r) direction towards the one or more apertures or ion exit regions so as to urge ions within the ion guide to the one or more apertures or ion exit regions.

The ion guide may be arranged and adapted such that ions within the ion guide are caused to exit the ion guide via the one or more apertures or ion exit regions.

The ion guide may be arranged and adapted such that a minimum in the pseudo-potential barrier is provided at the one or more apertures or ion exit regions such that ions within the ion guide are caused to exit the ion guide via the one or more apertures or ion exit regions exit the ion; and/or the ion guide may further comprise one or more extraction lenses or electrode arrangements arranged adjacent to the one or more apertures or ion exit regions, the one or more extraction lenses or electrode arrangements arranged and adapted to cause ions within the ion guide to exit the ion guide via the one or more apertures or ion exit regions.

The ion guide may be arranged and adapted:

such that ions at some, most or all angular (θ) displacements within the ion guide are caused to exit the ion guide via the one or more apertures or ion exit regions; and/or such that ions at some, most or all radial (r) displacements within the ion guide are caused to exit the ion guide via the one or more apertures or ion exit regions.

The ion guide may be arranged and adapted such that ions are caused to exit the ion guide via the one or more apertures or ion exit regions in the first (z) direction.

The ion guide may be arranged and adapted such that ions are caused to exit the ion guide via the one or more apertures or ion exit regions in the second (r) direction.

The ion guide may be arranged and adapted such that no trapping voltages are provided in the second (r) direction and/or such that ions are not trapped in the second (r) direction and/or such that no ion trapping occurs in the second (r) direction, e.g. so that ions can move freely to and/or away from the one or more apertures or ion exit regions and/or the one or more ion entrance regions, e.g. due to the one or more DC voltages.

The second device may be arranged and adapted to apply the one or more DC voltages to the first array of electrodes and/or to the second array of electrodes so as to urge ions within the ion guide in the second (r) direction towards the one or more apertures or ion exit regions, such that ions within the ion guide are caused to migrate to the one or more apertures or ion exit regions without separating according to a physico-chemical property.

The ion guide may be arranged and adapted such that ions are caused to exit the ion guide without separating according to a physico-chemical property.

The physico-chemical property may comprise, for example, mass to charge ratio and/or ion mobility.

The second device may be arranged and adapted to apply the one or more DC voltages to the first array of electrodes and/or to the second array of electrodes so as to urge ions within the ion guide in the second (r) direction towards the one or more apertures or ion exit regions, such that ions within the ion guide are caused to migrate to the one or more apertures or ion exit regions in a non-mass-selective manner.

The ion guide may be arranged and adapted such that ions are caused to exit the ion guide in non-mass-selective manner e.g. such that ions are not mass selectively ejected.

The ion guide may be arranged and adapted such that ions are not ejected directly onto or into a detector.

A buffer gas may be provided within the ion guide.

The buffer gas may be caused to flow through the ion guide, e.g. in a direction opposite to the direction of travel of ions, such as in the second (r) direction or a direction (−r) opposite to the second (r) direction.

According to another aspect there is provided a method of guiding ions in an ion guide comprising a first array of electrodes, a second array of electrodes, and one or more apertures or ion exit regions, wherein the first array of electrodes comprises a first plurality of arcuate electrodes arranged in parallel with one another and such that the first plurality of arcuate electrodes at least partially surround the one or more apertures or ion exit regions and/or wherein the second array of electrodes comprises a second plurality of arcuate electrodes arranged in parallel with one another and such that the second plurality of arcuate electrodes at least partially surround the one or more apertures or ion exit regions, the method comprising:

applying an AC or RF voltage to the first array of electrodes and to the second array of electrodes so as to confine ions within the ion guide in a first (z) direction that extends in a direction between the first and second arrays; and applying one or more DC voltages to the first array of electrodes and/or to the second array of electrodes so as to urge ions within the ion guide in a second (r) direction towards the one or more apertures or ion exit regions, such that ions within the ion guide are caused to migrate to the one or more apertures or ion exit regions.

According to another aspect there is provided an ion guide comprising:

a first array of electrodes and a second array of electrodes;

one or more apertures or ion entrance regions;

wherein the first array of electrodes comprises a first plurality of arcuate electrodes arranged in parallel with one another and such that the first plurality of arcuate electrodes at least partially surround the one or more apertures or ion entrance regions and/or wherein the second array of electrodes comprises a second plurality of arcuate electrodes arranged in parallel with one another and such that the second plurality of arcuate electrodes at least partially surround the one or more apertures or ion entrance regions;

a first device arranged and adapted to apply an AC or RF voltage to the first array of electrodes and to the second array of electrodes so as to confine ions within the ion guide in a first (z) direction that extends in a direction between the first and second arrays;

a second device arranged and adapted to apply one or more DC voltages to the first array of electrodes and/or to the second array of electrodes so as to urge ions within the ion guide in a second (r) direction away from the one or more apertures or ion entrance regions, such that ions within the ion guide are caused to migrate away from the one or more apertures or ion entrance regions.

According to another aspect there is provided a method of guiding ions in an ion guide comprising a first array of electrodes, a second array of electrodes, and one or more apertures or ion entrance regions, wherein the first array of electrodes comprises a first plurality of arcuate electrodes arranged in parallel with one another and such that the first plurality of arcuate electrodes at least partially surround the one or more apertures or ion entrance regions and/or wherein the second array of electrodes comprises a second plurality of arcuate electrodes arranged in parallel with one another and such that the second plurality of arcuate electrodes at least partially surround the one or more apertures or ion entrance regions, the method comprising:

applying an AC or RF voltage to the first array of electrodes and to the second array of electrodes so as to confine ions within the ion guide in a first (z) direction that extends in a direction between the first and second arrays; and applying one or more DC voltages to the first array of electrodes and/or to the second array of electrodes so as to urge ions within the ion guide in a second (r) direction away from the one or more apertures or ion entrance regions, such that ions within the ion guide are caused to migrate away from the one or more apertures or ion entrance regions.

According to another aspect there is provided a method of guiding ions in an ion guide comprising a first array of electrodes, a second array of electrodes, and one or more apertures or ion exit regions arranged within the first array, such that the electrodes in the first array of electrodes are arranged concentrically around the one or more apertures or ion exit regions and/or one or more apertures or ion exit regions arranged within the second array, such that the electrodes in the second array of electrodes are arranged concentrically around the one or more apertures or ion exit regions, the method comprising:

applying an AC or RF voltage to the first array of electrodes and to the second array of electrodes so as to confine ions within the ion guide in a first (z) direction that extends in a direction between the first and second arrays; and applying one or more DC voltages to the first array of electrodes and/or to the second array of electrodes so as to urge ions within the ion guide in a second (r) direction towards the one or more apertures or ion exit regions, such that ions within the ion guide are caused to migrate to the one or more apertures or ion exit regions.

According to another aspect there is provided an ion guide comprising:

a first array of electrodes and a second array of electrodes;

one or more apertures or ion entrance regions arranged within the first array, such that the electrodes in the first array of electrodes are arranged concentrically around the one or more apertures or ion entrance regions and/or one or more apertures or ion entrance regions arranged within the second array, such that the electrodes in the second array of electrodes are arranged concentrically around the one or more apertures or ion entrance regions;

a first device arranged and adapted to apply an AC or RF voltage to the first array of electrodes and to the second array of electrodes so as to confine ions within the ion guide in a first (z) direction that extends in a direction between the first and second arrays;

a second device arranged and adapted to apply one or more DC voltages to the first array of electrodes and/or to the second array of electrodes so as to urge ions within the ion guide in a second (r) direction away from the one or more apertures or ion entrance regions, such that ions within the ion guide are caused to migrate away from the one or more apertures or ion entrance regions.

According to another aspect there is provided a method of guiding ions in an ion guide comprising a first array of electrodes, a second array of electrodes, and one or more apertures or ion entrance regions arranged within the first array, such that the electrodes in the first array of electrodes are arranged concentrically around the one or more apertures or ion entrance regions and/or one or more apertures or ion entrance regions arranged within the second array, such that the electrodes in the second array of electrodes are arranged concentrically around the one or more apertures or ion entrance regions, the method comprising:

applying an AC or RF voltage to the first array of electrodes and to the second array of electrodes so as to confine ions within the ion guide in a first (z) direction that extends in a direction between the first and second arrays; and applying one or more DC voltages to the first array of electrodes and/or to the second array of electrodes so as to urge ions within the ion guide in a second (r) direction away from the one or more apertures or ion entrance regions, such that ions within the ion guide are caused to migrate away from the one or more apertures or ion entrance regions.

According to another aspect there is provided an ion mobility separator or spectrometer comprising an ion guide as described above. Ions may be caused to separate according to their ion mobility as they pass through the ion guide. A buffer gas may be provided within the ion guide. The one or more DC voltages may be used to force the ions through the buffer gas so that the ions separate according to their ion mobility as they pass through the gas.

According to another aspect there is provided a method of separating ions according to their ion mobility comprising the method of guiding ions as described above. Ions may be caused to separate according to their ion mobility as they pass through the ion guide. A buffer gas may be provided within the ion guide. The one or more DC voltages may be used to force the ions through the buffer gas so that the ions separate according to their ion mobility as they pass through the gas.

According to another aspect there is provided a mass spectrometer comprising an ion guide and/or an ion mobility separator or spectrometer as described above.

The mass spectrometer may further comprise an ion trap, such as an analytical ion trap. The ion trap may comprise a curved or annularly distributed ion trapping region. The ion guide may be used to deliver ions from a point source to the curved or annularly distributed ion trapping region. Additionally or alternatively, the ion guide may be used to capture and compress ions ejected from the curved or annularly distributed ion trapping region to the ion exit region of the ion guide.

According to another aspect there is provided a method of mass spectrometry comprising the method of guiding ions and/or the method of separating ions according to their ion mobility as described above.

The method of mass spectrometry may further comprise trapping ions in an ion trap, such as an analytical ion trap. The ions may be trapped in a curved or annularly distributed ion trapping region. Ions may be delivered from a point source to the curved or annularly distributed ion trapping region. Additionally or alternatively, ions ejected from the curved or annularly distributed ion trapping region may be captured and compressed to the ion exit region of the ion guide.

According to an aspect there is provided a device comprising a two dimensional ion guide with means of transporting ions from a diffuse or distributed ion source and concentrating those ions into a smaller region for subsequent transport and processing/analysis.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

According to an embodiment analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to an embodiment the process of Electron Transfer Dissociation fragmentation comprises interacting analyte ions with reagent ions, wherein the reagent ions comprise dicyanobenzene, 4-nitrotoluene or azulene.

BRIEF DESCRIPTION OF THE DRAWINGS

Various embodiments will now be described, by way of example only, and with reference to the accompanying drawings in which:

FIG. 1(*b*) shows schematically a perspective view of an ion guide in accordance with a second embodiment; FIG. 1(*c*) shows a time varying potential generated within the ion guide of the first embodiment; FIG. 1(*d*) shows a static potential generated within the ion guide of the second embodiment; FIG. 1(*e*) shows schematically a cross-sectional view of an ion guide in accordance with an embodiment; and FIG. 1(*f*)

Figure 1A:
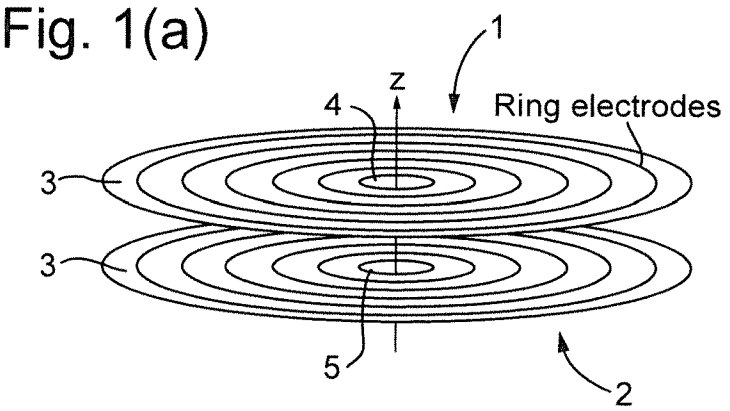
FIG. 1(*a*) shows schematically a perspective view of an ion guide in accordance with a first embodiment.
Figure 1B:
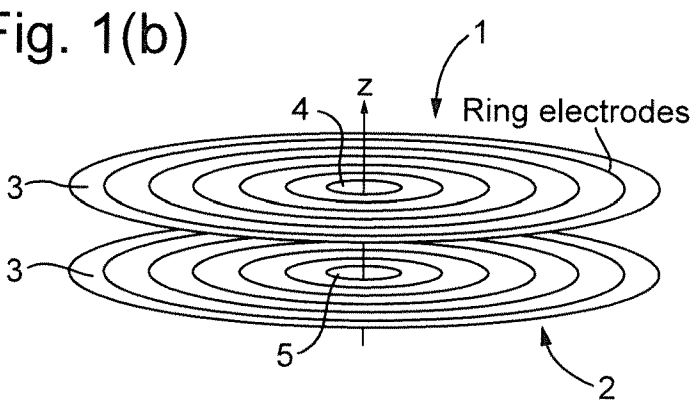
Figure 1C:
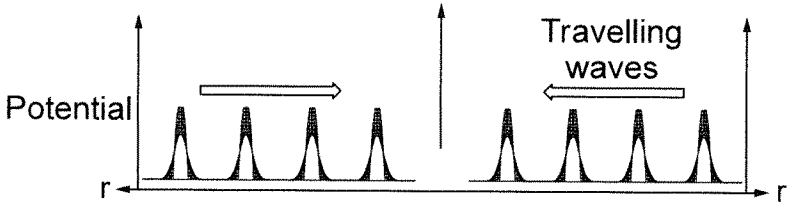
Figure 1D:
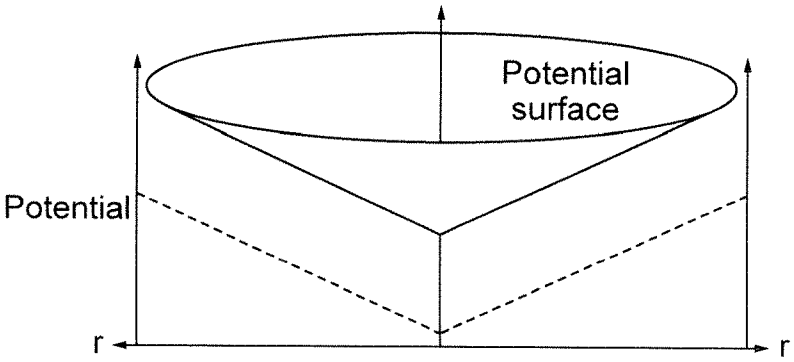
Figure 1F:
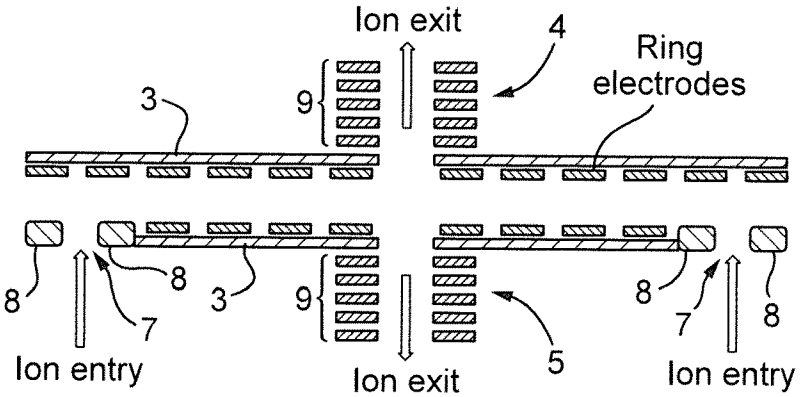
Figure 1E:
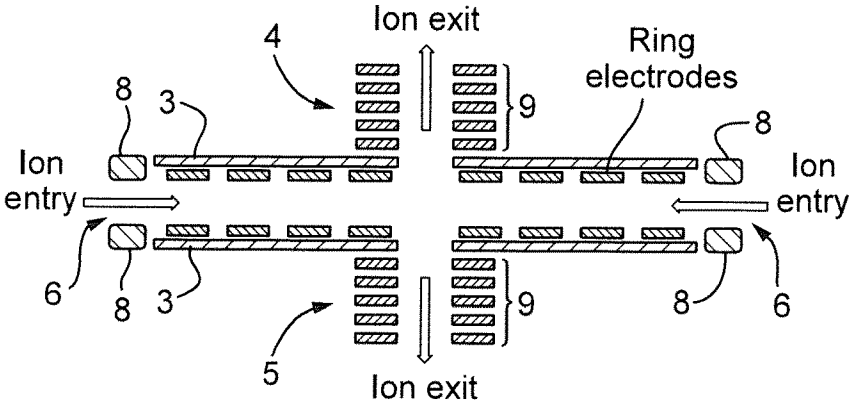
Figure 2A:
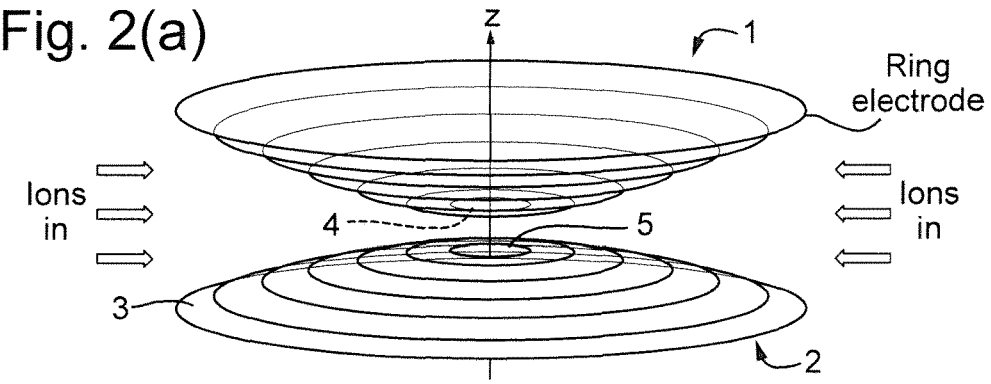
Figure 2B:
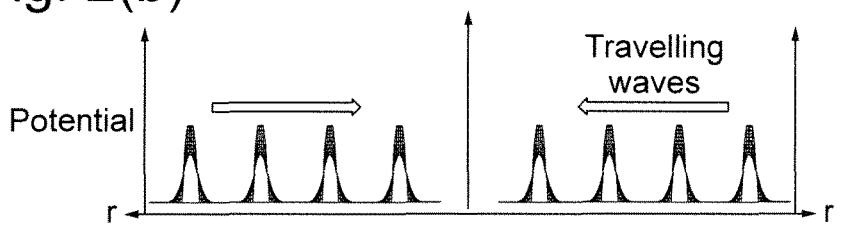
Figure 3A:
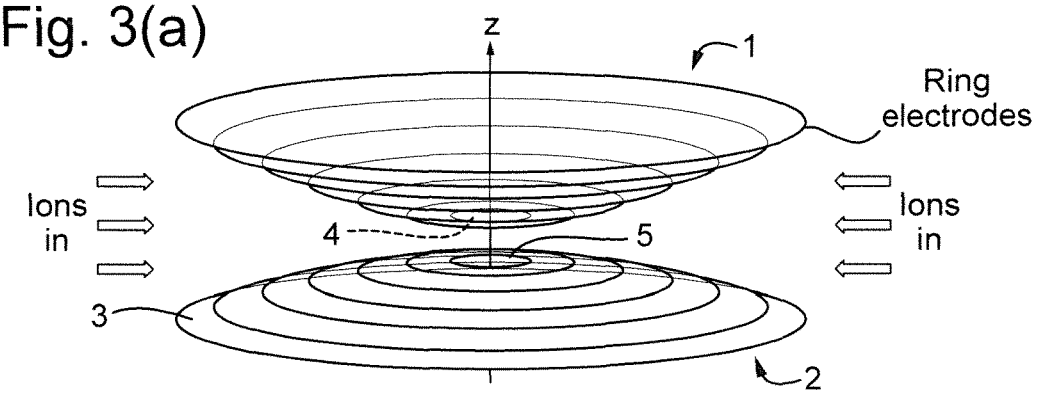
Figure 3B:
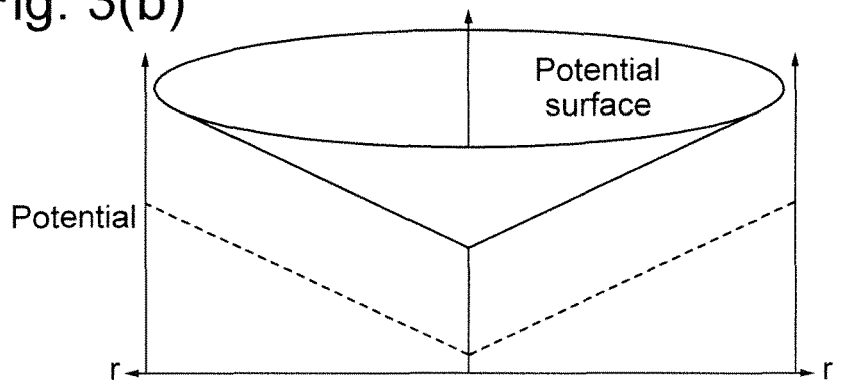

shows schematically a cross-sectional view of an ion guide in accordance with an embodiment;

FIG. 2(*a*) shows schematically a perspective view of an ion guide in accordance with a third embodiment; and FIG. 2(*b*) shows a time varying potential generated within the ion guide of the third embodiment; and FIG. 3(*a*) shows schematically a perspective view of an ion guide in accordance with a fourth embodiment; and FIG. 3(*b*) shows a time varying potential generated within the ion guide of the fourth embodiment.

Figure 4A:
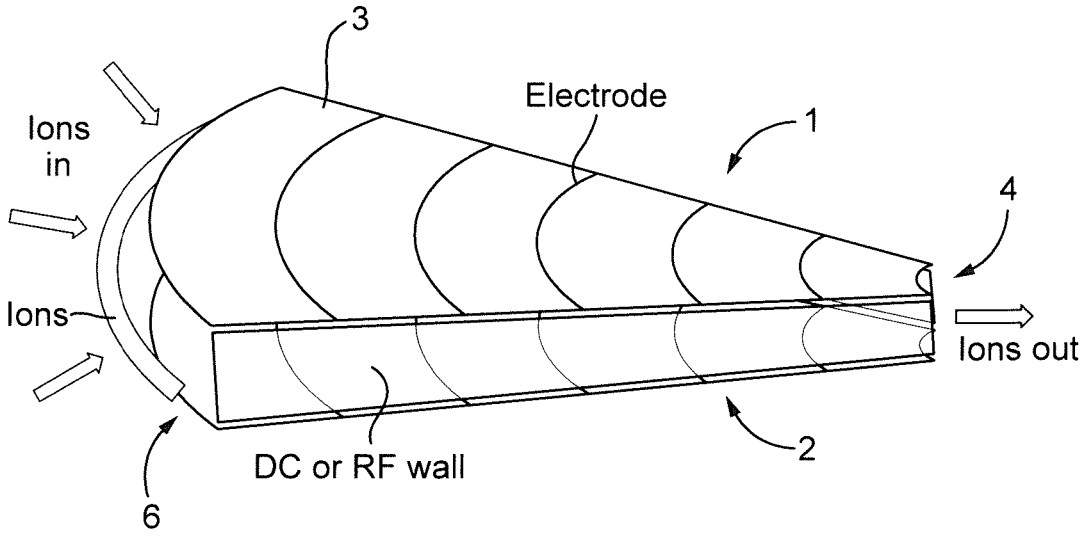
Figure 4B:
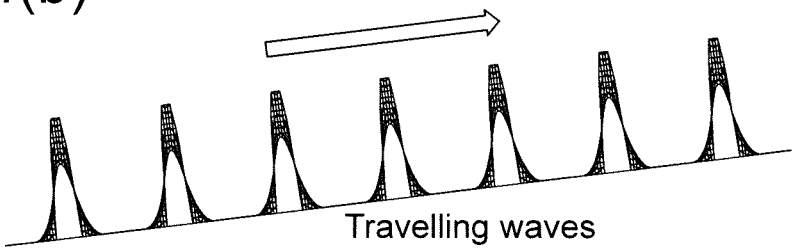

FIG. 4(*a*) shows schematically a perspective view of an ion guide in accordance with a fifth embodiment; and FIG. 4(*b*) shows a time varying potential generated within the ion guide of the fifth embodiment.

DETAILED DESCRIPTION

An embodiment will now be described.

As shown in FIG. 1, the ion guide may comprise a first planar array of electrodes 1 and a second planar array of electrodes 2. As shown in FIGS. 1(*a*) and 1(*b*), the first 1 and second 2 planar arrays of electrodes may comprise first and second pluralities of electrodes, such as first and second pluralities of concentric ring electrodes, respectively. As shown in FIGS. 1(*e*) and (*f*), the electrodes may be mounted on electrode supports, which may comprise printed circuit boards 3.

The first and second pluralities of electrodes may be arranged to be parallel to one another (e.g. in the second, radial (r) direction), may be separated by a displacement in a first (z) direction orthogonal to the planes of the electrodes, and may be aligned along the first (z) direction. (The second (r) direction may be the radial direction defined relative to the z-axis depicted in FIGS. 1(*a*)-(*d*).)

A buffer gas may be provided within the ion guide, e.g. between the arrays of electrodes. This can be used to collisionally cool ions within the ion guide.

A first ion exit 4 may be arranged in the plane of the first planar array of electrodes, and a second ion exit 5 may be arranged in the plane of the second planar array of electrodes. Each ion exit, may for example, be located at the centre of the first and/or second plurality of electrodes, e.g. at the centre of the concentric ring electrodes. Each ion exit may be provided as an aperture, e.g. in the first or second plurality of electrodes and/or in the electrode support. Each ion exit may comprise, for example, an aperture in the central ring electrode of the plurality of concentric ring electrodes.

One or more ion entrance regions may be provided such that ions can enter the ion guide over a wide range of (e.g. all) angular (θ) displacements. (The angular (θ) displacement may be defined relative to (i.e. around) the z-axis depicted in FIGS. 1(*a*)-(*d*), and may be orthogonal to the first (z) direction and the second, radial (r) direction.)

As shown in FIG. 1(*e*), ions may be arranged to enter the ion guide in a direction parallel to the first and second planes (the radial (r) direction). In this embodiment, ions may be arranged to enter the ion guide at the open ends of the ion guide between the first and second planar arrays of electrodes, i.e. at the perimeter or circumference of the arrays of electrodes. Thus, the ion entrance region 6 may comprise an annular region at the outer region of, and between, the first a second planar arrays of electrodes.

As shown in FIG. 1(*f*), additionally or alternatively, ions may be arranged to enter the ion guide in a direction orthogonal to the first and second planes, e.g. in the first (z) direction. In this embodiment, the ion entrance region 7 may comprise one or more annular regions arranged in the first and/or second plane, which may be in the outer region of the first and/or second planar array of electrodes.

One or more guard or extraction electrodes 8 may be provided at the ion entrance region(s) to selectively prevent or allow ions to enter the ion guide.

Ions may be confined in the first (z) direction under the influence of pseudo-potential barriers resulting from an AC or RF voltage being applied to the electrodes. Opposite phases of the AC or RF voltage may be applied to adjacent electrodes, e.g. adjacent concentric ring electrodes, of the first and/or second plurality of electrodes. The AC or RF voltage may generate a repulsive effective or pseudo-potential (e.g. a reflective pseudo-potential surface) which may act to prevent ions from striking the electrodes. This confines ions in the first (z) direction.

Ions may also be subjected to a force that urges ions in a direction parallel to the first and/or second plane, and that may be directed towards at least one of the ion exits 4, 5, e.g. inwardly towards an ion exit. The urging force may be directed towards the ion exit in an inward radial (r) direction. The urging force may cause ions to migrate to (i.e. to be transported to) one of the ion exits 4, 5. Ions at most or all angular (θ) displacements and/or at most or all radial (r) displacements within the ion guide may be caused to migrate to one of the ion exits 4, 5.

The direction in which the urging force acts may have (approximate) circular symmetry, e.g. centred on the ion exit, but this need not be the case. The direction in which the urging force acts may have some degree of rotational symmetry, e.g. at least 3-fold rotational symmetry, such that ions at any point within the ion guide (i.e. between the two planar arrays of electrodes) are urged inwardly towards an ion exit.

The urging force may be provided by an electric field, such as a static electric field or a time varying electric field. The static electric field may be provided by applying DC voltages to the first and/or second plurality of electrodes to form a DC voltage gradient that urges ions inwardly towards the ion exit. For example, DC voltages may be applied to the plurality of concentric (ring) electrodes to form a DC voltage gradient that urges ions radially inwards towards the ion exit. FIG. 1(*d*) illustrates a potential within the ion guide in accordance with this embodiment.

Additionally or alternatively, a time varying electric field may be provided by applying a DC voltage successively to the plurality of electrodes in a direction inwardly towards the ion exit. This creates a potential barrier that travels inwardly towards the ion exit and drives the ions inwardly towards the ion exit. For example, a DC voltage may be applied successively to the plurality of concentric (ring) electrodes in a direction from the outermost (ring) electrode (s) towards the innermost (ring) electrode(s). The travelling potential may be applied such that it repeatedly travels from the outermost electrode(s) to the innermost electrode(s). FIG. 1(*c*) illustrates a potential within the ion guide in accordance with this embodiment. The travelling potential may be applied such that it travels in the direction shown by the arrows.

Thus, according to an embodiment, ions may be confined in the first (z) direction within the first and second plurality of electrodes (i.e. by the pseudo-potential barriers), while at the same time the ions may be urged toward the one or more ion exits 4, 5, i.e. such that ions are caused to migrate to the one or more ion exits 4, 5. The net effect is to urge or focus ions to a focal point or volume in close proximity with (e.g. above) the one or more ion exits 4, 5.

Ions may be arranged to exit the ion guide via the one or more ion exits 4, 5. Ions may be urged or focused to the focal point adjacent to the one or more ion exits 4, 5, and are urged or forced through the one or more ion exits 4, 5. This may be achieved due to the pseudo-potential, e.g. no pseudo-potential barrier or a minimum in the pseudo-potential barrier is provided at the ion exit, e.g. as a result of the aperture in the central ring electrode. Additionally or alternatively, one or more arrangements of electrodes 9 may be provided at the one or more ion exits, and used to urge ions through the ion exit.

The voltages applied to the electrodes of the ion guide may be configured such that ions are caused to (freely) migrate to (are transported to) the one or more ion exits 4, 5 under the influence of the radial force (e.g. the static electric field and/or the time varying electric field). To achieve this no trapping potential may be provided in the second (r) radial direction. It will be appreciated that in various embodiments, the radial force (e.g. the static electric field and/or the time varying electric field) will act to urge ions to the ion exit without separating them (e.g. in a non-mass selective manner), and the force urging ions through the one or more ion exits 4, 5 will act to urge ions through the one or more ion exits 4, 5 without separating them (e.g. in a non-mass selective manner), e.g. such that ions within the ion guide are caused to exit the ion guide via the one or more exits 4, 5 without being separated (e.g. in a non-mass selective manner).

The overall effect of various embodiments is to guide ions from a region between the first and second plurality of electrodes to a region outside the first and second plurality of electrodes via the one or more ion exits 4, 5. Ions that arrive or that are present at any point (e.g. any angular (θ) displacement and/or any radial (r) displacement) within the first and second plurality of electrodes, and having any value of or a wide range of mass to charge ratios, will be guided through the one or more ion exits 4, 5, and will be effectively concentrated into a relatively narrow ion beam.

It will therefore be appreciated that various embodiments can effectively capture, transport, confine, focus, concentrate and/or collimate annularly distributed ions, e.g. into one or more beams of ions exiting the one or more ion exits 4, 5. Ions from various distributed sources may be focused, concentrated and/or collimated into a relatively narrow diameter beam, e.g. for passage through subsequent differential apertures or ion optics.

Furthermore, the design of various embodiments is relatively compact, e.g. because it does not rely on slowly urging ions to a more focused beam as the ions transit axially along a device. Thus, the ion guide advantageously has a relatively small footprint. In addition, the design of various embodiments means that the temporal fidelity of the ions arriving at the ion guide is advantageously maintained, irrespective of their entry point to the ion guide.

The ion guide can be used to transport ions from an annularly distributed source, such as a cylindrical ion guide or an annular trap, etc., to the first 4 and/or second 5 ion exit. Ions appearing at any point on the circumference of the ion guide at a given time will be transported and focused to the first 4 and/or second 5 ion exit together, maintaining the temporal fidelity of the original ions.

FIGS. 2 and 3 show further embodiments. The ion guides shown in FIGS. 2 and 3 are substantially similar to the ion guide of FIG. 1, and corresponding features are labelled with the same reference numerals. It will be appreciated that these embodiments may comprise any or all of the optional features described herein, as appropriate.

The ion guides of FIGS. 2 and 3 are substantially similar to the ion guide of FIG. 1, except that the first 1 and second 2 arrays of electrodes are not arranged in a plane. Instead, the first 1 and second 2 arrays of electrodes are arranged in dome-shaped or cone-shaped configurations. Each electrode (or group of electrodes) of the array of electrodes may be arranged at a different displacement in the first (z) direction (i.e. in the direction of the axis around which the electrodes are concentric). The displacement in the first (z) direction of each electrode (or group of electrodes) may increase or decrease from the innermost electrode to the outermost electrode.

The first 1 and second 2 arrays of electrodes may be arranged such the separation in the first (z) direction between electrodes in the first 1 and second 2 arrays of electrodes is minimum for the innermost electrodes of the arrays of electrodes, and may be maximum for the outermost electrodes of the arrays of electrodes.

FIG. 2(*b*) illustrates a potential within the ion guide in accordance with an embodiment in which a travelling potential is used to cause ions to migrate to the ion exit(s) 4, 5, which corresponds to the potential illustrated in FIG. 1(*c*). FIG. 3(*b*) illustrates a potential within the ion guide in accordance with an embodiment in which a static DC potential is used to cause ions to migrate to the ion exit(s) 4, 5, which corresponds to the potential illustrated in FIG. 1(*d*).

Other non-planar arrangements for the arrays of electrodes 1, 2 are possible. For example, one of the arrays of electrodes (i.e. the first 1 or second 2 array of electrodes) may be arranged in a plane, while the other array may not be arranged in a plane, e.g. may be arranged in a cone-shaped configuration.

Advantageously, in these embodiments, the ion entrance region can effectively be wider (in the first (z) direction) than in the embodiment of FIG. 1. The AC or RF voltage (which acts to confine ions within the ion guide in the first (z) direction) can be used to focus ions in the first (z) direction as they migrate from the outer region of the ion guide to the ion exit(s) 4, 5. Thus, it will be appreciated that these embodiments can be used to transport ions from a more distributed source.

In another embodiment, the ion guide may be operated as an Ion Mobility Separator or Spectrometer (IMS). In this embodiment, the buffer gas may be provided within the ion guide at an appropriate pressure, e.g., around 1 mbar. The buffer gas may be arranged to flow in a direction opposite to the direction in which the ions travel. As ions are urged towards the ion exit 4, 5 against the buffer gas, they may be caused to separate according to their ion mobility. Thus, the ion guide can provide a high capacity annular IMS that may be used to guide ions towards the one or more ion exits 4, 5 as ions are separated according to their ion mobility.

In various embodiments, alternative shapes of the ion guide can be provided and used, e.g. square, rectangular, etc.

In various embodiments, the one or more ion exits 4, 5 are not arranged at the centre of the ion guide, but in other positions within the first and/or second array. A plurality of ions exits may be provided and used, e.g. a plurality of ions exits within the first 1 and/or second 2 planar array of electrodes. Each ion exit may have a concentric arrangement of electrodes surrounding it, so that ions may be urged to the ion exit in the manner discussed above.

A further embodiment is illustrated in FIG. 4. Features of the ion guide shown in FIG. 4 that correspond to features of the earlier embodiments are labelled with the same reference numerals. It will be appreciated that this embodiment may comprise any or all of the optional features described herein, as appropriate.

The ion guide of FIG. 4 is effectively a portion or a sector of the ion guide of FIG. 1. The ion guide of FIG. 4 may be provided as a standalone device, i.e. as illustrated in FIG. 4(*a*). In this embodiment, the ion guide comprises a first array of electrodes 1 comprising a first plurality of arcuate or curved electrodes and a second array of electrodes 2 comprising a second plurality of arcuate or curved electrodes.

The first and/or second plurality of arcuate or curved electrodes may comprise a plurality of circular arc-shaped electrodes. The first plurality of arcuate or curved electrodes may be arranged to be parallel to one another, e.g. in a plane, e.g. in an approximate sector or circular sector configuration. The second plurality of arcuate or curved electrodes may be arranged to be parallel to one another, e.g. in a plane, e.g. in an approximate sector or circular sector configuration.

The plane in which the first plurality of electrodes are arranged and the plane in which the second plurality of electrodes are arranged may be parallel to one another (as shown in FIG. 4(*a*)), but this is not essential. The electrodes may be arranged such that the separation in the first (z) direction between electrodes in the first 1 and second 2 arrays of electrodes is minimum for the smallest electrodes of the arrays of electrodes (i.e. the electrodes closest to the ion exit 4), and may be maximum for the largest electrodes of the arrays of electrodes (i.e. the electrodes closest to the ion entrance 6). In other words, the arrays get closer together towards the ion exit 4.

The first plurality of arcuate or curved electrodes and the second plurality of arcuate or curved electrodes may be arranged so that each of the electrodes at least partially surrounds an ion exit 4. The ion exit 4 may be located adjacent to or between the smallest electrodes in the first 1 and second 2 array of electrodes, i.e. at the geometric origin of the circular sector. An ion entrance region 6 may be located adjacent to or between the largest electrodes in the first 1 and second 2 array of electrodes, i.e. at the circumference of the circular sector.

Ions may be caused to enter the ion guide via the ion entrance region 6. An AC or RF voltage is applied to the first array of electrodes 1 and to the second array of electrodes 2 so as to confine ions within the ion guide in the first (z) direction, and one or more DC voltages is applied to the first array of electrodes 1 and/or to the second array of electrodes 2 so as to urge ions within the ion guide in the second (r) direction towards the ion exit region 4, such that ions within the ion guide are caused to migrate to the ion exit region 4, i.e. in a corresponding manner as discussed above with reference to FIGS. 1-3. FIG. 4(*b*) shows one embodiment, where the one or more DC voltages comprises a travelling potential.

In addition to this, one or more (e.g. at least two) potential barriers may be provided so as to confine ions within the ion guide in a third direction perpendicular to the first (z) direction and to the second (r) direction (e.g. the angular (θ) direction). The one or more potential barriers may be provided on either side of the ion guide so as to prevent ions leaving the ion guide in the third direction. The one or more potential barriers may be generated by applying one or more AC or RF voltages or one or more DC voltages to one or more electrodes arranged along the outer edges of the ion guide (not shown in FIG. 4(*a*)).

The ion guide of this embodiment may advantageously be used to focus ions from a relatively diffuse source to a point or a narrow beam (in a corresponding manner as discussed above) as they migrate or are transported (and optionally as they are separated according to their ion mobility) from the ion entrance 6 to the ion exit 4. Advantageously, the curvature of the ion guide may be matched to the curvature of an incoming ion cloud such the ions are automatically brought to a focus as they migrate to the ion exit 4.

In alternative embodiments, any of the ion guides of FIGS. 1-3 may be operated in a mode of operation that effectively simulates the ion guide of FIG. 4. In these embodiments, one or more (e.g. at least two) potential barriers are provided so as to confine ions within the ion guide in a third direction perpendicular to the first (z) direction and to the second (r) direction (e.g. the angular (θ) direction). The one or more potential barriers may be provided on either side of an ion guiding region so as to prevent ions leaving the ion guiding region in the third direction. The one or more potential barriers may be generated by applying one or more AC or RF voltages or one or more DC voltages to one or more electrodes arranged along either side of the ion guiding region.

In an alternative embodiment, the ion guide may be used in reverse. It will be appreciated that in this embodiment, relatively concentrated ions, or ions from a point source may be distributed to form a relatively distributed or diffuse annular cloud of ions. For example, a concentrated ion beam may be distributed over a uniform annular volume.

According to this embodiment, the ion guide may have the same structure as described above, although the one or more ion exit regions 4, 5 will effectively act as one or more ion entrance regions, and the one or more ion entrance regions 6, 7 will effectively acts as one or more ion exit regions. Ions within the ion guide may be urged in the second (r) (radial) direction away from the one or more apertures or ion entrance regions 4, 5, such that ions at some, most or all angular (θ) displacements within the ion guide are caused to migrate away from the one or more apertures or ion entrance regions 4, 5, and may be caused to exit the ion guide via the one or more ion exit regions 6, 7.

The ion guide may be used in conjunction with an analytical ion trap that has a curved or annular trapping region to deliver ions from a point source to the curved or annular trapping region and/or for capturing and compressing annularly ejected ions from the curved or annular trapping region to the exit region of the ion guide.

It will be appreciated from the above that various embodiments can advantageously provide a relatively compact device that acts to capture, transport and concentrate an extended cloud of ions to a point, e.g. for subsequent transmission/analysis.

Although the present invention has been described with reference to preferred embodiments, it will be understood by those skilled in the art that various changes in form and detail may be made without departing from the scope of the invention as set forth in the accompanying claims.

The invention claimed is:

1. An ion guide comprising:

a first array of electrodes and a second array of electrodes;

one or more apertures or ion exit regions;

wherein said first array of electrodes comprises a first plurality of arcuate electrodes arranged in parallel with one another and such that said first plurality of arcuate electrodes at least partially surround said one or more apertures or ion exit regions and/or wherein said second array of electrodes comprises a second plurality of arcuate electrodes arranged in parallel with one another and such that said second plurality of arcuate electrodes at least partially surround said one or more apertures or ion exit regions;

a first device arranged and adapted to apply an AC or RF voltage to said first array of electrodes and to said second array of electrodes so as to confine ions within said ion guide in a first (z) direction that extends in a direction between said first and second arrays;

a second device arranged and adapted to apply one or more DC voltages to said first array of electrodes and/or to said second array of electrodes so as to urge ions within said ion guide in a radial (r) direction relative to an axis about which said first and/or second plurality of arcuate electrodes are arranged towards said one or more apertures or ion exit regions, such that ions within said ion guide are caused to migrate to said one or more apertures or ion exit regions, and such that ions within said ion guide are caused to exit said ion guide via said one or more apertures or ion exit regions in a non-mass-selective manner; and one or more ion entrance regions arranged and adapted such that ions can enter said ion guide via said one or more ion entrance regions in said first (z) and/or said radial (r) direction, and at some or all angular (θ) displacements around the axis about which said first plurality of arcuate electrodes and/or said second plurality of arcuate electrodes are arranged, wherein said one or more ion entrance regions are arranged and adapted such that ions can enter said ion guide at at least 90% of the angular displacements;

wherein the one or more ion entrance regions comprise an annular region located at or close to the circumference of said first array of electrodes and/or said second array of electrodes;

wherein said second device is arranged and adapted:

to apply different DC voltages to different electrodes of said first array of electrodes and/or said second array of electrodes so as to create a DC voltage gradient that urges ions within said ion guide in said radial (r) direction to said one or more apertures or ion exit regions; and/or to successively apply a DC voltage to different electrodes of said first array of electrodes and/or said second array of electrodes so as to create a travelling DC potential barrier that travels in said radial (r) direction towards said one or more apertures or ion exit regions so as to urge ions within said ion guide to said one or more apertures or ion exit regions; and to apply said one or more DC voltages to said first array of electrodes and/or to said second array of electrodes so as to urge ions within said ion guide in said radial (r) direction towards said one or more apertures or ion exit regions, such that ions within said ion guide are caused to migrate to said one or more apertures or ion exit regions; and wherein said ion guide is arranged and adapted such that said one or more DC voltages cause said ions to freely migrate in said radial (r) direction, without being trapped in said radial (r) direction;

wherein said ion guide is further arranged and adapted such that ions appearing at any point on the circumference of said one or more ion entrance regions at a given time will be transported and focused to said one or more apertures or ion exit regions; and wherein said ion guide is configured to receive annular distributed ions at the one or more ion entrance regions from a cylindrical ion guide or annular trap, and to collimate said annular distributed ions to an ion beam by said one or more DC voltages transporting and focusing said annular distributed ions to said one or more apertures or ion exit regions without said ions being trapped in said radial (r) direction.

2. An ion guide as claimed in claim 1, wherein:

said one or more apertures or ion exit regions are arranged within said first array and/or within said second array; and said first plurality of arcuate electrodes are arranged concentrically around said one or more apertures or ion exit regions and/or wherein said second plurality of arcuate electrodes are arranged concentrically around said one or more apertures or ion exit regions.

3. An ion guide as claimed in claim 2, wherein:

said first array of electrodes comprises a first plurality of continuous electrodes, wherein each continuous electrode is arranged concentrically around said one or more apertures or ion exit regions, and/or said second array of electrodes comprises a second plurality of continuous electrodes, wherein each continuous electrode is arranged concentrically around said one or more apertures or ion exit regions; and/or said first array of electrodes comprises a first plurality of groups of electrodes, wherein each group of electrodes is arranged concentrically around said one or more apertures or ion exit regions so as to substantially surround said one or more apertures or ion exit regions and/or said second array of electrodes comprises a second plurality of groups of electrodes wherein each group of electrodes is arranged concentrically around said one or more apertures or ion exit regions so as to substantially surround said one or more apertures or ion exit regions.

4. An ion guide as claimed in claim 3, wherein:

said first array of electrodes comprises a first plurality of closed loop, ring, circular or oval electrodes arranged concentrically around said one or more apertures or ion exit regions and/or said second plurality of electrodes comprises a second plurality of closed loop, ring, circular or oval electrodes arranged concentrically around said one or more apertures or ion exit regions; and/or said first array of electrodes comprises a first plurality of rotationally symmetric groups of electrodes wherein each of said groups of electrodes is arranged concentrically around said one or more apertures or ion exit regions and/or said second plurality of electrodes comprises a second plurality of rotationally symmetric groups of electrodes wherein each of said groups of electrodes is arranged concentrically around said one or more apertures or ion exit regions.

5. An ion guide as claimed in claim 1, wherein:

said first and second arrays of electrodes are arranged at different displacements in said first (z) direction; and/or said first (z) direction is substantially orthogonal to said radial (r) direction.

6. An ion guide as claimed in claim 1, wherein:

said first array of electrodes is arranged in a first plane and/or said second array of electrodes is arranged in a second plane; or said first array of electrodes is arranged in a non-planar configuration and/or said second array of electrodes is arranged in a non-planar configuration.

7. An ion guide as claimed in claim 1, wherein said second device is arranged and adapted to apply said one or more DC voltages to said first array of electrodes and/or to said second array of electrodes so as to urge ions within said ion guide in said radial (r) direction to said one or more apertures or ion exit regions, such that ions, that are at any angular (θ) displacement around an axis about which said first and/or said second plurality of arcuate electrodes are arranged, within said ion guide are caused to migrate to said one or more apertures or ion exit regions.

8. An ion guide as claimed in claim 1, wherein said second device is arranged and adapted to apply said one or more DC voltages to said first array of electrodes and/or to said second array of electrodes so as to urge ions within said ion guide in said radial (r) direction to said one or more apertures or ion exit regions such that ions within said ion guide at some or all radial (r) displacements, relative to the axis about which said first and/or said second plurality of arcuate electrodes are arranged, are caused to migrate to said one or more apertures or ion exit regions.

9. An ion guide as claimed in claim 1, wherein:

said ion guide further comprises one or more extraction lenses or electrode arrangements arranged adjacent to said one or more apertures or ion exit regions, said one or more extraction lenses or electrode arrangements arranged and adapted to cause ions within said ion guide to exit said ion guide via said one or more apertures or ion exit regions.

10. An ion guide as claimed in claim 1, wherein said ion guide is arranged and adapted such that ions are caused to exit said ion guide via said one or more apertures or ion exit regions in said first (z) direction.

11. An ion guide as claimed in claim 1, wherein a buffer gas is provided within said ion guide.

12. A method of guiding ions in an ion guide comprising a first array of electrodes, a second array of electrodes, one or more apertures or ion exit regions, and one or more ion entrance regions, wherein said one or more ion entrance regions comprise an annular region located at or close to the circumference of the first array of electrodes and/or the second array of electrodes, wherein said first array of electrodes comprises a first plurality of arcuate electrodes arranged in parallel with one another and such that said first plurality of arcuate electrodes at least partially surround said one or more apertures or ion exit regions and/or wherein said second array of electrodes comprises a second plurality of arcuate electrodes arranged in parallel with one another and such that said second plurality of arcuate electrodes at least partially surround said one or more apertures or ion exit regions, the method comprising:

applying an AC or RF voltage to said first array of electrodes and to said second array of electrodes so as to confine ions within said ion guide in a first (z) direction that extends in a direction between said first and second arrays; and applying one or more DC voltages to said first array of electrodes and/or to said second array of electrodes so as to urge ions within said ion guide in a radial (r) direction relative to an axis about which said first and/or second plurality of arcuate electrodes are arranged towards said one or more apertures or ion exit regions, such that ions within said ion guide are caused to migrate to said one or more apertures or ion exit regions, and such that ions within said ion guide are caused to exit said ion guide via said one or more apertures or ion exit regions in a non-mass-selective manner; and causing ions to enter said ion guide via said one or more ion entrance regions in said first (z) and/or said radial (r) direction, and at some or all angular (θ) displacements around the axis about which said first plurality of arcuate electrodes and/or said second plurality of arcuate electrodes are arranged, wherein said one or more ion entrance regions are arranged and adapted such that ions can enter said ion guide at at least 90% of the angular displacements;

wherein applying said one or more DC voltages comprises applying different DC voltages to different electrodes of said first array of electrodes and/or said second array of electrodes so as to create a DC voltage gradient that urges ions within said ion guide in said radial (r) direction to said one or more apertures or ion exit regions; and/or wherein applying said one or more DC voltages comprises successively applying a DC voltage to different electrodes of said first array of electrodes and/or said second array of electrodes so as to create a travelling DC potential barrier that travels in said radial (r) direction towards said one or more apertures or ion exit regions so as to urge ions within said ion guide to said one or more apertures or ion exit regions; and wherein applying said one or more DC voltages comprises applying said one or more DC voltages to said first array of electrodes and/or to said second array of electrodes so as to urge ions within said ion guide in said radial (r) direction towards said one or more apertures or ion exit regions, such that ions within said ion guide are caused to migrate to said one or more apertures or ion exit regions;

wherein applying said one or more DC voltages comprises applying said one or more DC voltages such that said ions freely migrate in said radial (r) direction, without being trapped in said radial (r) direction;

wherein applying said one or more DC voltages comprises applying said one or more DC voltages such that ions appearing at any point on the circumference of said one or more ion entrance regions at a given time will be transported and focused to said one or more apertures or ion exit regions; and wherein the method comprises receiving annular distributed ions at the one or more ion entrance regions from a cylindrical ion guide or an annular trap, and collimating said annular distributed ions to an ion beam by said one or more DC voltages transporting and focusing said annular distributed ions to said one or more apertures or ion exit regions without said ions being trapped in said radial (r) direction.

13. An ion guide comprising:

a first array of electrodes and a second array of electrodes;

one or more apertures or ion entrance regions;

wherein said first array of electrodes comprises a first plurality of arcuate electrodes arranged in parallel with one another and such that said first plurality of arcuate electrodes at least partially surround said one or more apertures or ion entrance regions and/or wherein said second array of electrodes comprises a second plurality of arcuate electrodes arranged in parallel with one another and such that said second plurality of arcuate electrodes at least partially surround said one or more apertures or ion entrance regions;

a first device arranged and adapted to apply an AC or RF voltage to said first array of electrodes and to said second array of electrodes so as to confine ions within said ion guide in a first (z) direction that extends in a direction between said first and second arrays;

a second device arranged and adapted to apply one or more DC voltages to said first array of electrodes and/or to said second array of electrodes so as to urge ions within said ion guide in a radial (r) direction relative to an axis about which said first and/or second plurality of arcuate electrodes are arranged away from said one or more apertures or ion entrance regions, such that ions within said ion guide are caused to migrate away from said one or more apertures or ion entrance regions, and such that ions within said ion guide are caused to exit said ion guide in a non-mass-selective manner; and one or more ion exit regions arranged and adapted such that ions can exit said ion guide via said one or more ion exit regions in said first (z) and/or said radial (r) direction, and at some or all angular (θ) displacements around the axis about which said first plurality of arcuate electrodes and/or said second plurality of arcuate electrodes are arranged, wherein said one or more ion exit regions are arranged and adapted such that ions can exit said ion guide at at least 90% of the angular displacements;

wherein the one or more ion exit regions comprise an annular region located at or close to the circumference of said first array of electrodes and/or said second array of electrodes;

wherein said second device is arranged and adapted:

to apply different DC voltages to different electrodes of said first array of electrodes and/or said second array of electrodes so as to create a DC voltage gradient that urges ions within said ion guide in said radial (r) direction away from said one or more apertures or ion entrance regions; and/or to successively apply a DC voltage to different electrodes of said first array of electrodes and/or said second array of electrodes so as to create a travelling DC potential barrier that travels in said radial (r) direction away from said one or more apertures or ion entrance regions so as to urge ions within said ion guide away from said one or more apertures or ion entrance regions; and to apply said one or more DC voltages to said first array of electrodes and/or to said second array of electrodes so as to urge ions within said ion guide in said radial (r) direction away from said one or more apertures or ion entrance regions, such that ions within said ion guide are caused to migrate away from said one or more apertures or ion entrance regions; and wherein said ion guide is arranged and adapted such that said one or more DC voltages cause said ions to freely migrate in said radial (r) direction, without being trapped in said radial (r) direction;

wherein said ion guide is further arranged and adapted such that ions appearing at said one or more apertures or ion entrance regions at a given time will be transported away from said one or more apertures or ion entrance regions and will exit said ion guide via said one or more ion exit regions; and wherein said ion guide is configured to receive an ion beam at the one or more apertures or ion entrance regions, and to distribute said ions to an annular volume by said one or more DC voltages transporting said ions to said one or more exit regions without said ions being trapped in said radial (r) direction.

14. An ion guide comprising:

a first array of electrodes and a second array of electrodes;

one or more apertures or ion exit regions;

wherein said first array of electrodes comprises a first plurality of arcuate electrodes arranged in parallel with one another and such that said first plurality of arcuate electrodes at least partially surround said one or more apertures or ion exit regions and/or wherein said second array of electrodes comprises a second plurality of arcuate electrodes arranged in parallel with one another and such that said second plurality of arcuate electrodes at least partially surround said one or more apertures or ion exit regions;

wherein said first plurality of arcuate electrodes are arranged in a sector configuration and/or said second plurality of arcuate electrodes are arranged in a sector configuration;

a first device arranged and adapted to apply an AC or RF voltage to said first array of electrodes and to said second array of electrodes so as to confine ions within said ion guide in a first (z) direction that extends in a direction between said first and second arrays;

a second device arranged and adapted to apply one or more DC voltages to said first array of electrodes and/or to said second array of electrodes so as to urge ions within said ion guide in a radial (r) direction relative to an axis about which said first and/or second plurality of arcuate electrodes are arranged towards said one or more apertures or ion exit regions, such that ions within said ion guide are caused to migrate to said one or more apertures or ion exit regions, and such that ions within said ion guide are caused to exit said ion guide via said one or more apertures or ion exit regions in a non-mass- selective manner; and one or more ion entrance regions arranged and adapted such that ions can enter said ion guide via said one or more ion entrance regions in said first (z) and/or said radial (r) direction, and at some or all angular (θ) displacements around the axis about which said first plurality of arcuate electrodes and/or said second plurality of arcuate electrodes are arranged, wherein said one or more ion entrance regions are arranged and adapted such that ions can enter said ion guide at at least 10% of the angular displacements;

wherein the one or more ion entrance regions comprise a curved region located at or close to the perimeter of said first array of electrodes and/or said second array of electrodes;

wherein said second device is arranged and adapted:

to apply different DC voltages to different electrodes of said first array of electrodes and/or said second array of electrodes so as to create a DC voltage gradient that urges ions within said ion guide in said radial (r) direction to said one or more apertures or ion exit regions; and/or to successively apply a DC voltage to different electrodes of said first array of electrodes and/or said second array of electrodes so as to create a travelling DC potential barrier that travels in said radial (r) direction towards said one or more apertures or ion exit regions so as to urge ions within said ion guide to said one or more apertures or ion exit regions; and to apply said one or more DC voltages to said first array of electrodes and/or to said second array of electrodes so as to urge ions within said ion guide in said radial (r) direction towards said one or more apertures or ion exit regions, such that ions within said ion guide are caused to migrate to said one or more apertures or ion exit regions; and wherein said ion guide is arranged and adapted such that said one or more DC voltages cause said ions to freely migrate in said radial (r) direction, without being trapped in said radial (r) direction;

wherein said ion guide is further arranged and adapted such that ions appearing at any point on the perimeter of said one or more ion entrance regions at a given time will be transported and focused to said one or more apertures or ion exit regions; and wherein said ion guide is configured to receive arcuately distributed ions at the one or more ion entrance regions from an arcuate ion guide or arcuate trap, and to collimate said arcuately distributed ions to an ion beam by said one or more DC voltages transporting and focusing said arcuately distributed ions to said one or more apertures or ion exit regions without said ions being trapped in said radial (r) direction.

* * * * *